US007757983B2

(12) United States Patent
Lipowski et al.

(10) Patent No.: US 7,757,983 B2
(45) Date of Patent: Jul. 20, 2010

(54) COMMINUTING APPARATUS WITH A REDUCED NUMBER OF BEARINGS

(75) Inventors: Wolfgang Lipowski, Seck (DE); Thomas Sturm, Zehnhausen (DE)

(73) Assignee: Vecoplan AG, Bad Marienberg (DE)

( * ) Notice: Subject to any disclaimer, the term of this patent is extended or adjusted under 35 U.S.C. 154(b) by 730 days.

(21) Appl. No.: 11/616,957

(22) Filed: Dec. 28, 2006

(65) Prior Publication Data

US 2007/0164139 A1 Jul. 19, 2007

(51) Int. Cl.
*B02C 7/14* (2006.01)
*B02C 1/10* (2006.01)

(52) U.S. Cl. ..... 241/36; 241/101.2

(58) Field of Classification Search ..... 241/101.2, 241/242, 243, 36, 282, 280
See application file for complete search history.

(56) References Cited

U.S. PATENT DOCUMENTS 4,545,539 A * 10/1985 Steffensen ..... 241/73
5,547,136 A * 8/1996 Steffens et al. ..... 241/73
6,094,795 A * 8/2000 Davenport ..... 29/407.1
6,745,961 B2 * 6/2004 Korstvedt ..... 241/21
7,478,772 B2 * 1/2009 Wang ..... 241/224

* cited by examiner

*Primary Examiner*—Faye Francis
(74) *Attorney, Agent, or Firm*—Alston & Bird LLP

(57) ABSTRACT

A comminuting apparatus for waster and/or production residues includes a drive device having at least one high-pole three-phase synchronous motor that is operatively connected to a comminuting shaft having at least one shaft bearing arrangement. The motor is connected directly to the comminuting shaft and the comminuting shaft over its working region has comminuting tools that cooperate with a counterpart member for comminuting the material to be processed. The comminuting shaft extends axially into the three-phase synchronous motor and the at least one shaft bearing arrangement of the comminuting shaft is surrounded at least in portion-wise manner by the synchronous motor.

14 Claims, 6 Drawing Sheets

COMMINUTING APPARATUS WITH A REDUCED NUMBER OF BEARINGS

Figure 1A:
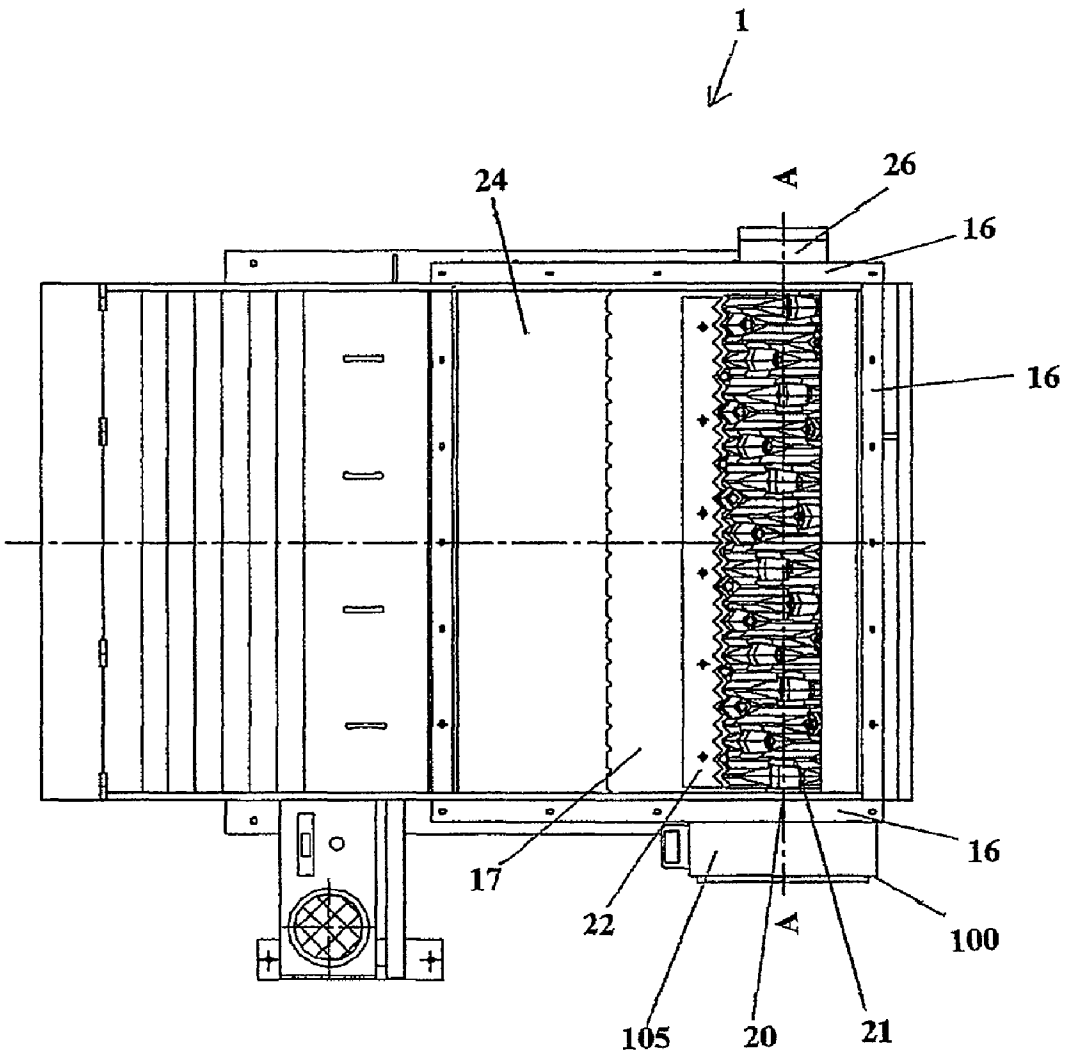

The invention concerns a comminuting apparatus for waste and/or production residues comprising a drive device with a high-pole three-phase synchronous motor which is connected directly to a comminuting shaft having at least one shaft bearing arrangement, wherein over its working region at Its periphery the comminuting shaft has comminuting tools which co-operate with a counterpart means for comminuting the material to be processed.

Comminuting apparatuses of that kind are used for example for comminuting wood, paper, plastic material, rubber, textiles, production residues or waste from trade and industry, but also for comminuting bulky refuse, domestic refuse, paper collections and collections from waste-disposal organizations as well as hospital wastes etc. In that respect the material to be comminuted is comminuted by the co-operation of the comminuting shaft with a stationary or movable counterpart means by cutting, shearing, squeezing, tearing and/or rubbing.

An apparatus of the general kind set forth is described in German patent DE 103 33 359 B3. The use of a high-pole three-phase synchronous motor (torque motor) in the drive device makes it possible to provide a high level of torque at a comparatively low speed of rotation. Dispensing with a transmission reduces the moment of inertia of the drive device. That makes it possible to decrease the risk of damage in the drive itself or at the comminuting shaft in the event of a sudden blockage of the rotor, which is caused for example by a foreign body in the material to be comminuted. Under some circumstances it is thus also possible to dispense with the usual protection measures such as disengagement clutches, slipping clutches or shear-pin clutches. Shocks and impacts caused during operation are damped in the magnetic field of the synchronous motor and pass at the most in a reduced form to the drive housing. The low number of machine components means that the overall level of efficiency of the drive is very good, whereby it is possible to save on energy. A further consequence of the low number of machine components is that the maintenance involvement is reduced.

The object of the invention is to develop a comminuting apparatus of the general kind set forth, in such a way that its structure is further simplified.

The invention attains that object in a surprisingly simple fashion by means of a comminuting apparatus in which the comminuting shaft extends axially into the three-phase synchronous motor and the at least one shaft bearing arrangement of the comminuting shaft is surrounded at least in portion-wise manner by the synchronous motor.

The specified structural configuration provides that the comminuting shaft In the comminuting apparatus according to the invention at least partially performs the function of a motor shaft and in that respect it is possible to save on at least one shaft bearing.

A three-phase synchronous motor used for the drive for the apparatus according to the invention has a large number of poles in order to provide a high level of torque and to produce a low basic speed, Three-phase synchronous motors with more than eight poles are preferably used, those with more than sixteen poles can be used even more advantageously, while those with more than twenty two poles can be used in an extremely advantageous feature. The numbers of poles of the synchronous motor, which are specified as being advantageous, are suitable in particular with a mains frequency of 50 Hz.

As the three-phase synchronous motor is connected directly to the comminuting shaft, both involve the same direction of rotation and the same rotary speed. In that respect no drive element which transmits torque and/or force rotates faster than the comminuting shaft. That connection between the motor and the comminuting shaft can be of a rigid or elastic nature.

In the comminuting apparatus according to the invention, the synchronous motor encloses at least in portion-wise manner a shaft bearing arrangement of the comminuting shaft. In that respect the bearing is peripherally surrounded at least over a portion of its axial extent by radially outwardly disposed motor parts such as the stator device (110) and/or the rotor device.

Further advantageous embodiments of the invention are set forth in the appendant claims.

It may be desirable if an electrical supply device controlled by a control device includes a frequency converter, to the output of which the synchronous motor is connected, so that the rotary speed of the comminuting shaft can be easily adjusted to the respective operating conditions. Furthermore, it is possible for the maximum torque to be provided over the entire rotary speed range, whereby for example the start-up phase can be facilitated or the apparatus can be started up even under load. In that respect the apparatus according to the invention can be actuated in such a way that the rotary speed is adapted while maintaining a maximum torque in response to operating conditions or the torque is adjusted also in response to operating conditions.

It may be desirable if the comminuting shaft which extends into the synchronous motor Is in that region in the form of a motor shaft and is connected to the rotor device, that is to say the rotor of the synchronous motor. In that way it is possible to save on the motor shaft as well as the associated motor shaft bearings, as the function of the motor shaft is taken over by the comminuting shaft. The coupling of the rotor device to the comminuting shaft can advantageously be in the form of a releasable connecting device. In that respect, it is possible to use both a force-locking kind of connection and also a positively locking kind of connection. That connection can be rigid in the axial direction, the radial direction and the peripheral, that is to say polar direction. In order to reduce the mechanical loading on the components however It is also possible to provide an elastic coupling between the comminuting shaft and the rotor device, in particular a rotationally elastic connection. The connection or coupling can advantageously be designed for the transmission of torques but not for the conversion thereof.

The provision of an otherwise usual torque support for transmitting the drive and reaction moments to the housing of the comminuting apparatus according to the invention can be eliminated if the stator device of the synchronous motor is connected to the machine housing of the comminuting apparatus. That further reduces the component expenditure for the comminuting apparatus according to the invention.

The comminuting apparatus can be operated with a plurality of three-phase synchronous motors. By way of example the rotor member field can be produced by the use of a permanent magnet arrangement, but it is also possible for the rotor member to be provided with an exciter winding arrangement in which a direct current flows. In that case the rotor device can include an external rotor member co-operating with a rotary field of an internal stator of the synchronous motor. In other embodiments however it is also possible for the rotor device to include an internal rotor member co-operating with a rotary field of an external stator of the synchronous motor. The use of a rotor device of the synchronous motor which has a double rotor member, that is to say two rotor member arrangements, which are radially spaced, is particularly advantageous by virtue of the high torque which can be produced. In a particularly preferred embodiment both exciter fields of the double rotor member are produced by permanent magnet arrangements. That rotor device is arranged between a stator device which includes an internal stator and an external stator, wherein the double rotor member co-operates with a rotary field of the internal stator and with a rotary field of the external stator for driving the comminuting shaft.

A particularly compact structure is afforded if the entire axial extent of the shaft bearing arrangement is arranged in the interior of the synchronous motor. In that case the shaft bearing arrangement is enclosed by radially outwardly disposed parts of the synchronous motor such as the stator device and/or the rotor.

If the stator device extends axially as far as the machine housing of the comminuting apparatus, the former can be connected directly to the machine housing for receiving the reaction moments.

In order to carry reaction moments on the shaft bearing which is enclosed at least in portion-wise manner by the synchronous motor, it can be provided that the shaft bearing of the comminuting shaft has a bearing housing which is rigidly connected to the machine housing of the comminuting shaft. In that case it may be desirable If the comminuting shaft extends axially through the bearing housing and the portion of the shaft which projects beyond the bearing housing is connected to the rotor device of the synchronous motor.

It may be desirable if the common bearing assembly for the comminuting shaft and the rotor of the synchronous motor is arranged approximately centrally in relation to the axial extent of the rotor. It may further be advantageous if the bearing arrangement is arranged as closely as possible to the machine housing to which it can be fixed for carrying the reaction moments. The proximity of the bearing arrangement to the machine housing has the advantage that this provides that the lever arms and thus the inevitable bending moments can be kept low.

Even when using a comminuting shaft which is as stiff as possible, the fluctuating bending moments which occur in operation lead to corresponding changing elastic deformation phenomena in the shaft, in the form of flexing of the shaft. Although, to achieve a high level of efficiency for the motor, it may be advantageous to provide a minimum possible air gap between the rotor device and the stator device of the synchronous motor, the above-described elastic flexing of the shaft in operation can prevent a small air gap from being set, as otherwise the rotor and the stator would come into contact in operation. If however the shaft bearing arrangement or the bearing housing is mounted substantially centrally with respect to the extent of the rotor, the influences of deformation of the comminuting shaft on the synchronous motor can be minimised so that, with such a configuration for a comminuting apparatus according to the invention, it is possible to maintain an extremely small air gap of for example between 1 and 2 mm between the rotor device and the stator device. With such a configuration, the changes in the air gap in operation of the comminuting apparatus are at their smallest, in which respect the greatest changes in the air gap occur at the axially front and rear ends of the rotor.

In the case of a comminuting apparatus according to the invention, which is designed for high levels of mechanical loading, it can be provided that the synchronous motor and the comminuting shaft are rigidly connected together and together have two mutually spaced shaft bearing arrangements. In that case it may be appropriate if the two shaft bearing arrangements are arranged externally on the machine housing of the comminuting shaft and the respective bearing housing is connected to them to carry reaction moments. In that case the bearing arrangements are accessible from the exterior, which makes maintenance easier.

It has proven to be desirable when using two shaft bearing arrangements for supporting the component afforded by the coupling of the comminuting shaft and the synchronous motor, to provide a fixed/movable bearing assembly. Having regard to the high mechanical loading on the comminuting shaft, it may be desirable to provide for example a movable bearing in the form of a rolling bearing in a movable bearing arrangement with a high level of radial load-carrying capability while the fixed bearing is a rolling bearing in a fixed bearing arrangement which withstands very high axial and radial loadings. In order to ensure that the relative positions of the stator device and the rotor device of the synchronous motor remain as stable as possible relative to each other both in the axial direction and also in the radial direction, it may be desirable to provide the fixed bearing for the shaft in the region of the motor, for example the above-mentioned rolling bearing in a fixed bearing arrangement.

In order to increase the torque provided for the comminuting operation, it can be provided that not one but two three-phase synchronous motors of that kind are used to drive a single comminuting shaft. In that case, a respective shaft bearing arrangement can be appropriately disposed at each of the two ends of the comminuting shaft, wherein the two ends of the comminuting shaft, as already described hereinbefore, are respectively connected to the rotor device of one of the two three-phase synchronous motors to drive the comminuting shaft. The principle according to the invention, that the shaft bearing arrangement is surrounded or enclosed at least in portion-wise manner by the respectively associated synchronous motor can be implemented in that case for both shaft bearing arrangements. The electrical control or electrical supply for the motors must then be such that the rotors of the two motors rotate at the same speed.

The counterpart means for co-operating with the comminuting tools when comminuting the material to be processed can be for example a one-piece blade transverse member which is fixed with respect to the comminuting tools mounted on the comminuting shaft and which has a blade mounted thereto, or also a plurality of counterpart blades which are stationary in relation to the comminuting tools mounted on the shaft. In addition, the counterpart means can also be adapted to be movable. In particular it may be desirable if the counterpart means for a comminuting shaft is an adjacent comminuting shaft so that the adjacent comminuting shafts each provide the respective comminuting means for the other, for comminuting the material to be processed. That principle can also be applied to three or even more mutually juxtaposed comminuting shafts, in which case, when a plurality of comminuting shafts are arranged in mutually juxtaposed relationship, a stationary counterpart means can be provided for each of the respective outer ones thereof. In the case of a comminuting apparatus according to the invention which has a plurality of comminuting shafts, it may be advantageous in that respect If one of the above-described couplings according to the invention between the comminuting shafts and the three-phase synchronous motor is implemented in relation to at least two of the comminuting shafts. In that respect it is for example also in accordance for the invention to provide two comminuting shafts for a comminuting apparatus, the two comminuting shafts each providing the counterpart means for the other, for comminuting the material to be processed, in which case both comminuting shafts are each driven In the described manner by at least-one respective three-phase synchronous motor.

Particularly in uses which cause a reduced mechanical loading on the comminuting shaft or the bearings, it may be advantageous, for the purposes of avoiding structural design complication and expenditure, for a comminuting shaft to be supported in an overhung or cantilever relationship at one of its two ends. That makes it possible to save on the shaft bearing which is at a position remote from the three-phase synchronous motor. If however two three-phase synchronous motors are to be provided for a comminuting shaft, a respective associated shaft bearing arrangement is to be used for each of the two motors.

Figure 1B:
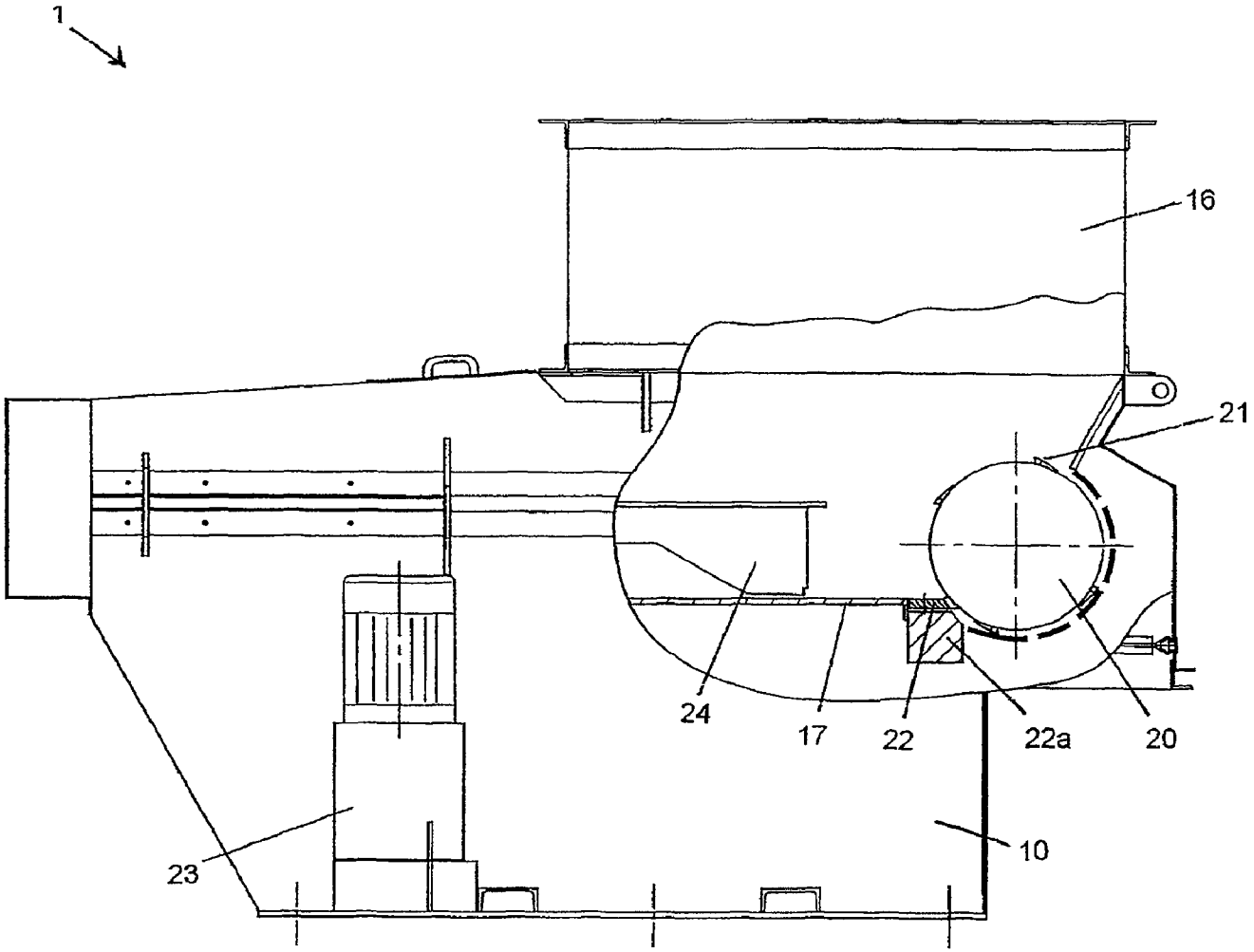
Figure 1C:
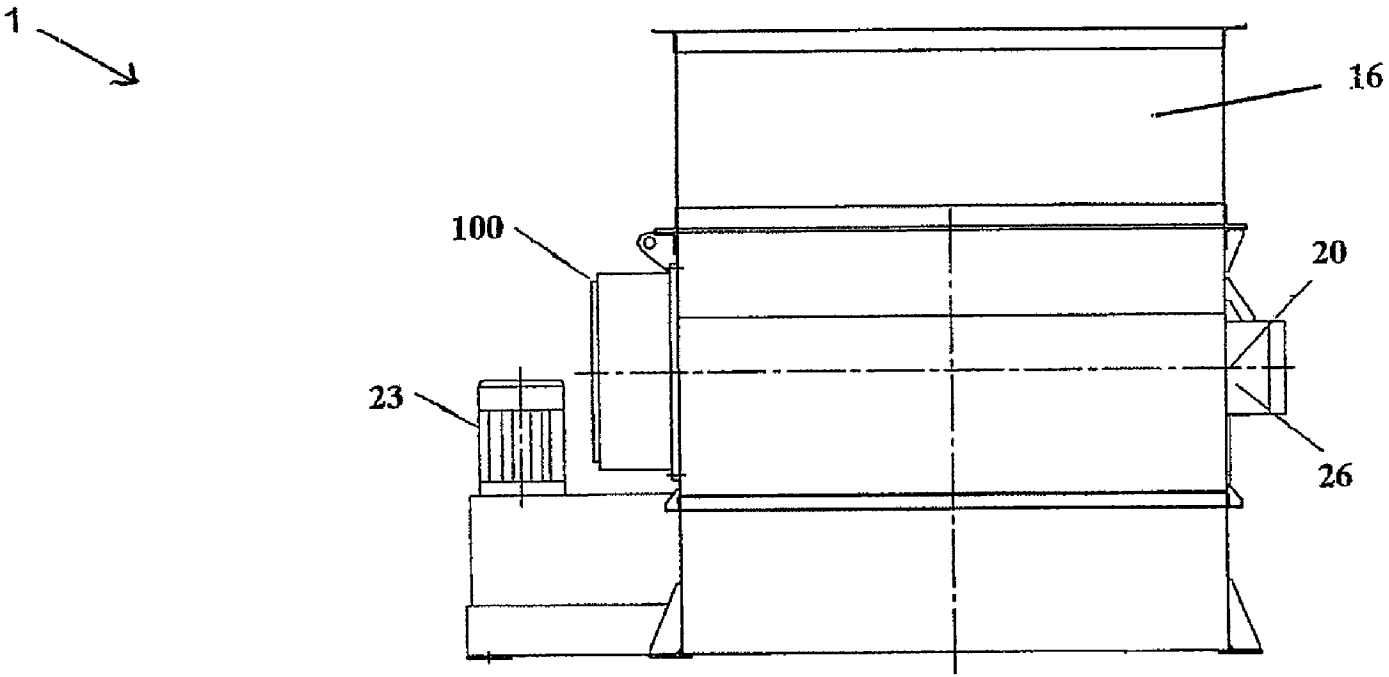
Figure 2:
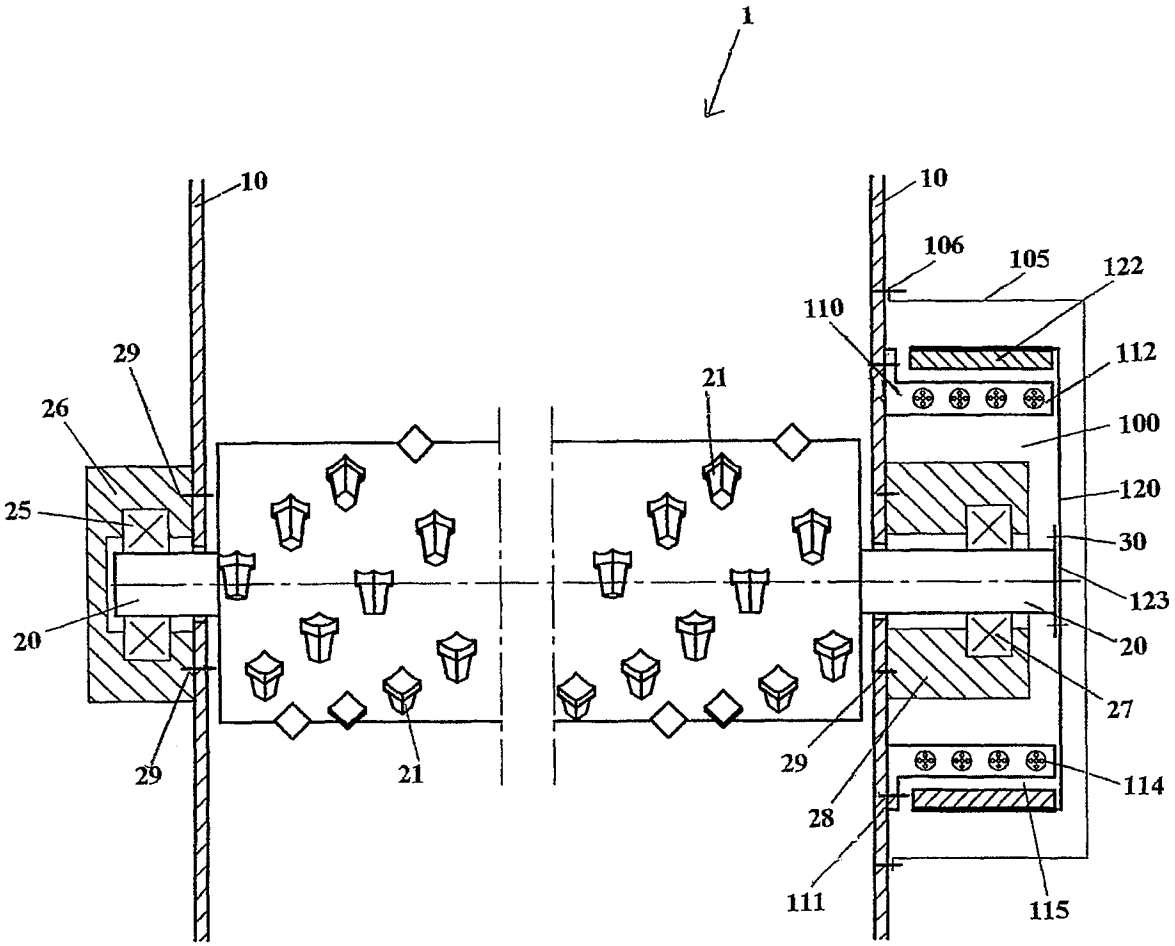
Figure 3:
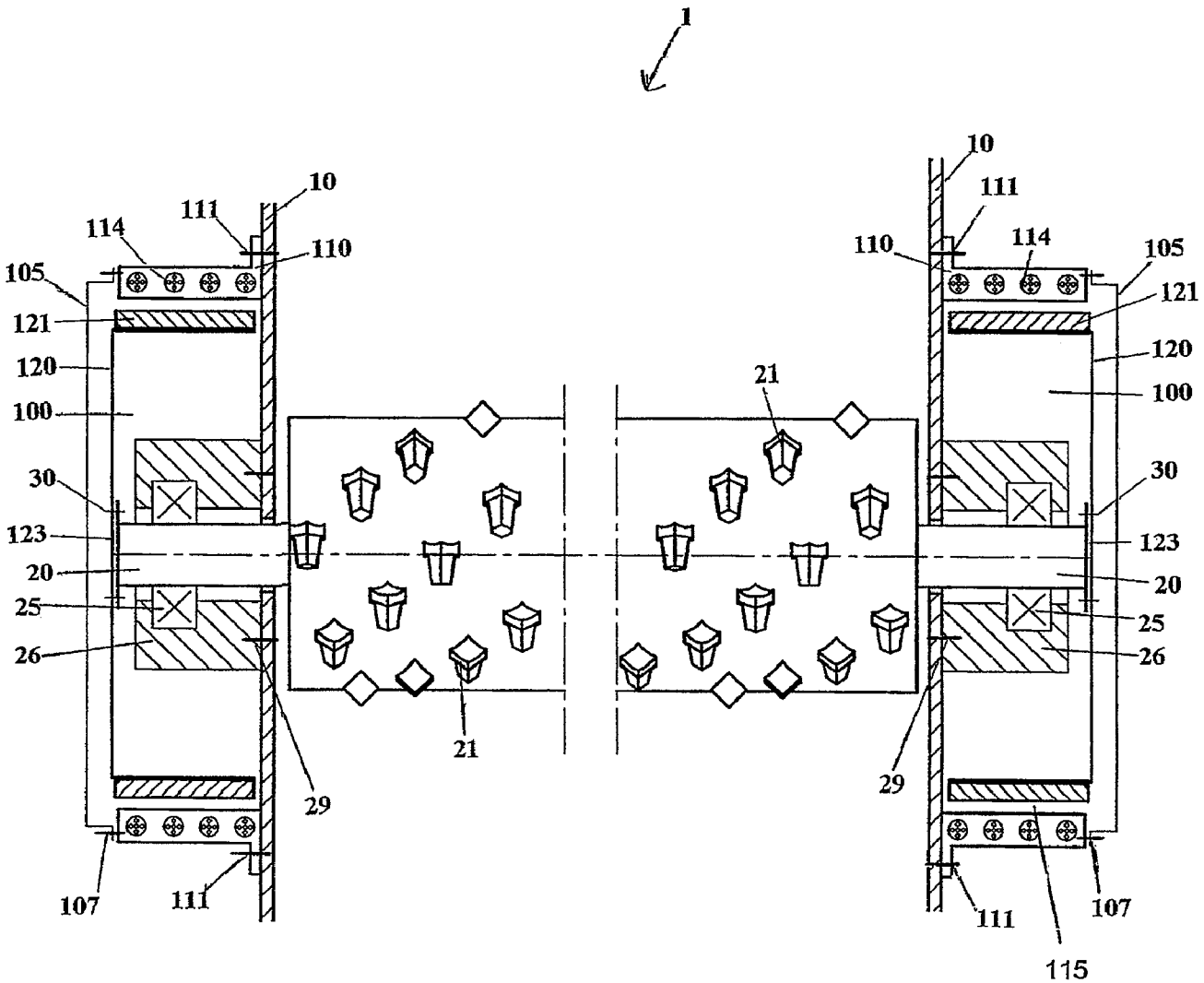
Figure 4:
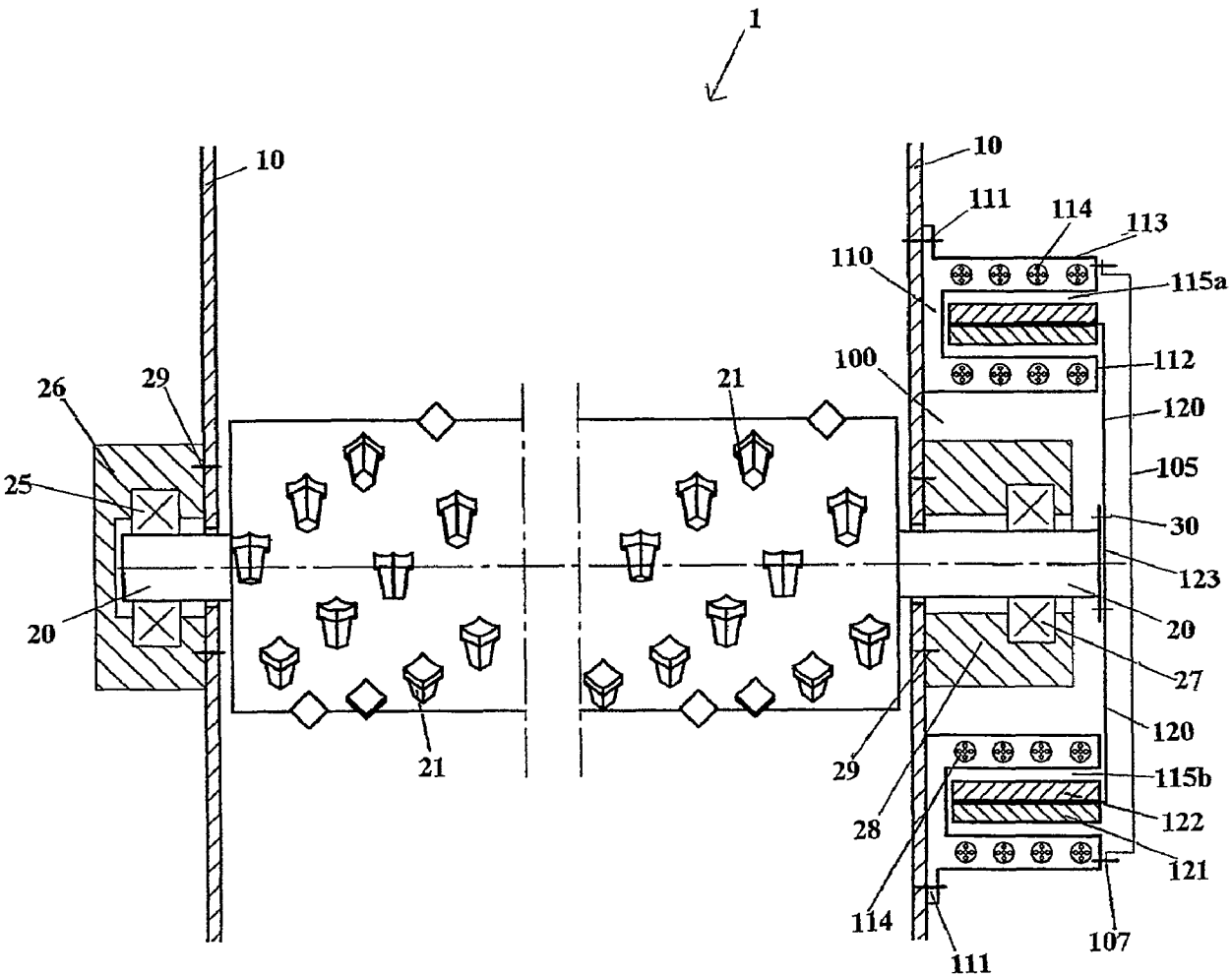

The invention is described hereinafter by the description of a number of embodiments and further features according to the invention with reference to the accompanying drawings in which:

FIG. 1*a* shows a plan view of a comminuting apparatus according to the invention, FIG. 1*b* shows a side view of the comminuting apparatus of FIG. 1*a*, with a partially broken-away machine housing, FIG. 1*c* shows a front view of the comminuting apparatus of FIG. 1, FIG. 2 is a diagrammatic view in cross-section through a first embodiment of a comminuting apparatus according to the invention, FIG. 3 is a diagrammatic view in cross-section through a second embodiment of a comminuting apparatus according to the invention, and FIG. 4 is a diagrammatic view in cross-section through a third embodiment of a comminuting apparatus according to the invention.

Referring to FIG. 1*a*-1*c*, shown therein are various perspective views of a comminuting apparatus 1 according to the invention, by way of example thereof, as can be used for example for waste such as wood, paper or plastic materials. While FIG. 1*a* shows a plan view of the apparatus, FIG. 1*b* shows a side view with the machine housing partially broken away and FIG. 1*c* shows a front view of the comminuting apparatus designed in accordance with the invention. It has a housing 10 through which a comminuting shaft 20 extends. For supporting the comminuting shaft 20, arranged externally laterally on the machine housing 10 is a bearing housing 26 which is rigidly connected to the machine housing of the comminuting apparatus and which serves as the first bearing location for the comminuting shaft. At the other end of the shaft, a three-phase synchronous motor 100 is again connected externally to the housing 10, wherein a second bearing arrangement for the shaft is arranged integrated into the motor, in the manner described hereinafter. Over its working region which in the example given is defined by wall portions 16 of the housing, the comminuting shaft 20 has comminuting tools in the form of cutting rings 21, at its periphery. The comminuting space is defined by the table 17 and the wall portions 16. The comminuting tools co-operate with a stationary counterpart means in the form of a blade transverse member 22*a* to which a blade 22 is fixed for comminuting the material to be processed, see FIG. 1*b*.

The material to be comminuted drops from above into the comminuting space defined by the wall portions 16 on to the table surface 17 and is subsequently fed to the comminuting tools by a slider 24 which is movable horizontally by means of the hydraulic drive 23. After the slider 24 has reached its operative position which is closest to the comminuting shaft, the slider is retracted again by means of the hydraulic drive, whereby further material to be comminuted drops on to the table 17 and subsequently, after the reversal of the movement of the slider, is moved in a direction towards the comminuting shaft. The comminuted material drops down in relation to the plan view shown in FIG. 1*a* and is transported away therefrom for example by means of a belt.

As can be seen from the Figures, no torque support is required for transmitting reaction moments from the motor to the machine housing as the motor bears directly against the machine housing 10 and is fixed thereto, without the need to provide a further component like such a torque support.

As will be described in greater detail hereinafter, the comminuting shaft extends axially into the three-phase synchronous motor and in the described embodiment is there rigidly connected to the rotor member of the motor (motor rotor). In the example given here, the high-pole three-phase synchronous motor which is also referred to as a torque motor has 24 poles. The motor is connected in a manner not shown here to the output of an electrical supply arrangement which is controlled by a control device and which in turn is itself connected to a conventional 3-phase mains network using the usual mains frequency of 50-60 Hz. The control device includes a frequency converter, the rotary condition of the motor and thus the rotary condition of the comminuting shaft being detected and passed to the control device. Additional items of information, in particular about the condition of the material to be comminuted, can be passed to the control device by way of further input lines, and those items of information can be used by the control device to control the motor. The frequency converter operates in conventional manner insofar as it produces direct current from the 3-phase alternating current from the mains network by means of a rectifier bridge and then converts that by means of an inverter into a 3-phase alternating current of variable frequency and voltage, with which the three-phase synchronous motor is then fed. Depending on the respective operating situation, the frequency converter is actuated by the control device to set a given output voltage, an associated output current and/or frequency, so that in the present example the motor speed, that is to say the rotary speed of the comminuting shaft, can be set at between 1 and 340 1/min.

FIG. 2 shows a diagrammatic view for a first embodiment illustrating the relative arrangement of the shaft bearing, the comminuting shaft, the housing and the three-phase synchronous motor, in cross-section. This substantially corresponds to a section taken along line A-A in the view in FIG. 1*a*. The comminuting shaft 20 extends on both sides through the housing 10, wherein on the left-hand side in the Figure, a bearing housing 26 is fixedly connected to the housing 10 by means of a screw connection 29, at which a rolling bearing is supported in a movable bearing arrangement 25 in which the shaft 20 is supported. In the interior of the housing, that is to say over the working region of the comminuting shaft, the comminuting shaft has comminuting tools 21. With its other end, the shaft 20 also extends through the housing 10 and protrudes therefrom, see the right-hand side in FIG. 2. A 24-pole three-phase synchronous motor 100 is arranged in a position of bearing against the housing 10. The motor bears with its stator 110 directly against the housing 10 and is coupled thereto by means of a rigid connection 111. In addition, a bearing housing 28 is connected to the housing 10 by way of a further rigid connection 29. The bearing housing 28 is arranged in radially inward relationship with respect to the stator 110 and in that respect is enclosed by the motor. The bearing housing 28 holds a rolling bearing in a fixed bearing arrangement 27, here a self-aligning roller bearing, through which the shaft 20 extends. Depending on the respective design configuration involved the shaft 20 extends only a few centimeters beyond the bearing 27 and is connected by way of a rigid shaft-rotor coupling 30 to a portion of the rotor 123, which portion extends substantially perpendicularly to the axis. In the embodiment set forth here the coupling is afforded by a simple screw connection. In that respect that shaft-rotor coupling is designed in the form of a rigid disk coupling. That rotor 120 is in the form of an external rotor member in relation to the stator 110 and in the example set forth has a permanent magnet arrangement 122 to produce an exciter field, the permanent magnet arrangement 122 co-operating with the rotary field of the stator winding 114.

The fact that, as described, the comminuting shaft extends into the motor 100 means that in this respect the motor shaft which is otherwise usual, and therewith also the corresponding motor shaft bearing arrangement, can be omitted.

In an embodiment which is not shown, the bearing arranged within the motor is disposed centrally within the axial extent of the rotor, whereby the influences due to deformation of the comminuting shaft on the motor in operation are minimised.

In the example shown in FIG. 2, the permanent magnet arrangement 122 is arranged radially outwardly relative to the stator 110. The gap 115 between the rotor and the stator can be set to be very small, for example a few millimeters, by virtue of using the fixed bearing 27 which can carry particularly high radial forces. The motor housing 105 is also connected to the machine housing 10 of the comminuting apparatus 1 by way of a rigid connection 106.

A further embodiment is shown in FIG. 3, which differs essentially in two features from the embodiment shown in FIG. 2. FIG. 3 shows a comminuting shaft as part of a comminuting apparatus according to the Invention, on which two three-phase synchronous motors 100 of a symmetrical structure and also operated symmetrically are arranged. The shaft 20 in turn extends into each respective synchronous motor so that the shaft is radially surrounded by the stator 110 and the rotor member 120 respectively. In relation to the apparatus shown in FIG. 2, identical components are identified by the same references. The structure of the three-phase synchronous motors in FIG. 3, in relation to that shown in FIG. 2, differs only insofar as, in FIG. 3, the motor is provided with an internal rotor member so that the stator 110 is arranged radially outwardly with respect to the rotor 120. The arrangement of the bearing housings and the bearings relative to the machine housing and the motor respectively is identical to the embodiment shown in FIG. 2. In this respect, the embodiment shown in FIG. 3 also provides that one of the two shaft bearings is in the form of a movable bearing and the other is in the form of a fixed bearing in order to take account of the inevitable production tolerances, deformation during the comminuting operation by virtue of the bending moments and thermal expansion phenomena, in operation. By virtue of the inwardly disposed rotor 120, the cover of the respective motor can be fixed by way of a screw connection 107 to the stator 110 which is itself coupled to the machine housing 10 by way of the rigid connection 111.

As already set forth in relation to the comminuting apparatus according to the invention as shown in FIG. 2, it can also be provided in the embodiment shown in FIG. 3 that the shaft bearing arranged within the respective motor is to be disposed centrally in relation to the axial extent of the rotor, in order to keep low the influences of deformation of the comminuting shaft on the motor, which deformation occurs in operation. That provides that the air gap 115 between the rotor and the stator can be set to be very small, for example 1 to 2 mm.

FIG. 4 shows a further embodiment of a comminuting apparatus 1 according to the invention. The mounting arrangement and the coupling of the comminuting shaft 20 to the machine housing 10 by means of the rolling bearing in a movable bearing arrangement (at the left-hand side in FIG. 4) is identical to that shown in FIG. 2, and in that respect attention is directed to the corresponding description. The three-phase synchronous motor shown in FIG. 4 for the comminuting apparatus is in the form of a double-rotor motor and accordingly has an inner and an outer permanent magnet arrangement 122, 121 which form exciter fields which co-operate with the corresponding rotary fields of the stator 110. The latter has an internal stator 112 and an external stator 113 which respectively cause rotary fields associated with the exciter fields. Once again, the same components are denoted by the same references, in relation to the view in FIG. 2. The arrangement of the bearing housing 28 and the bearing 27 in a fixed bearing arrangement within the motor 100 and the position thereof relative to the housing 10 is also identical to the situation shown in FIG. 2. The embodiment described with reference to FIG. 4 is distinguished by a particularly high level of torque. In an embodiment which is not shown, such a double-rotor three-phase synchronous motor can also be coupled to the other end of the comminuting shaft, similarly to the embodiment set forth in FIG. 3. It will be appreciated that the embodiment shown in FIG. 4 can also provide that both bearings are arranged axially centrally relative to the rotor.

The comminuting apparatuses shown in the Figures each have a single comminuting shaft. An embodiment which is not illustrated has a plurality of and in particular two comminuting shafts which extend parallel to each other and which, by virtue of the respective comminuting tools arranged at their periphery, provide the counterpart means for each other, for comminuting the material to be processed. Like the examples described in the Figures, those embodiments can be so designed that one or two three-phase synchronous motors are arranged on an individual comminuting shaft, as described.

List of References

1 comminuting apparatus
10 machine housing of the comminuting app
16 wall portion
17 table
20 comminuting shaft
21 comminuting tool
22 blade
22*a* blade transverse member
23 hydraulic drive
24 slider
25 rolling bearing in a movable bearing arrangement
26 bearing housing
27 rolling bearing in a fixed bearing arrangement
28 bearing housing
29 screw connection
30 shaft-rotor coupling
100 three-phase synchronous motor
105 motor housing/motor cover
106 screw connection
107 screw connection
110 stator, stator device
111 screw connection
112 internal stator
113 external stator
114 stator winding
115,
115*a*,

115*b* gap
120 rotor member, rotor device
121outer permanent magnet arrangement
122 inner permanent magnet arrangement
123 rotor member—connecting portion

The invention claimed is:

1. A comminuting apparatus for waste and/or production residues comprising a drive device with a high-pole three-phase synchronous motor which is connected directly to a comminuting shaft having at least one shaft bearing arrangement, the motor comprising a rotor device and a stator device, wherein over its working region at its periphery the comminuting shaft has comminuting tools which co-operate with a counterpart means for comminuting the material to be processed, and wherein the comminuting shaft extends axially into the three-phase synchronous motor and the at least one shaft bearing arrangement of the comminuting shaft is surrounded at least partially by at least one of the rotor device and the stator device of the synchronous motor.

2. A comminuting apparatus as set forth in claim 1 wherein the part of the comminuting shaft which projects into the synchronous motor is in the form of a motor shaft and is connected to the rotor device of the synchronous motor.

3. A comminuting apparatus as set forth in claim 2 wherein the rotor device of the synchronous motor is connected to the comminuting shaft by way of a releasable connecting device.

4. A comminuting apparatus as set forth in claim 2, wherein the stator device of the synchronous motor is connected to a machine housing of the comminuting apparatus.

5. A comminuting apparatus as set forth in claim 2, wherein the stator device comprises an internal stator and the rotor device includes an external rotor member co-operating with a rotary field of the internal stator of the synchronous motor.

6. A comminuting apparatus as set forth in claim 2, wherein the stator device comprises an external stator and the rotor device includes an internal rotor member co-operating with a rotary field of the external stator of the synchronous motor.

7. A comminuting apparatus as set forth in claim 2, wherein the stator device comprises an internal stator and an external stator and the rotor device includes a double rotor member co-operating with a rotary field of the internal stator and with a rotary field of the external stator of the synchronous motor.

8. A comminuting apparatus as set forth in claim 1, wherein the shaft bearing arrangement of the comminuting shaft, which bearing arrangement is enclosed at least partially by the synchronous motor, is arranged axially approximately in the center of the stator device.

9. A comminuting apparatus as set forth in claim 1, wherein the shaft bearing arrangement of the comminuting shaft, which bearing arrangement is enclosed at least partially by the synchronous motor, has a bearing housing which is rigidly connected to a machine housing of the comminuting apparatus.

10. A comminuting apparatus as set forth in claim 1, wherein the synchronous motor and the comminuting shaft are rigidly connected together and together have two mutually spaced shaft bearing arrangements.

11. A comminuting apparatus as set forth in claim 1, wherein a respective shaft bearing arrangement is arranged in the region of each of the two ends of the comminuting shaft and there are provided two drive devices each having a respective three-phase synchronous motor each having a rotor device, wherein each of the two ends of the comminuting shaft is rigidly connected to the rotor device of a respective one of the two three-phase synchronous motors for driving the comminuting shaft and wherein the shaft bearing arrangements are surrounded at least partially by the rotor device of the respectively associated synchronous motor.

12. A comminuting apparatus as set forth in claim 1, further comprising a second comminuting shaft which extends parallel to the first comminuting shaft and which at its periphery has comminuting tools co-operating with those of the first comminuting shaft for affording the counterpart means for comminuting the material to be processed, wherein the second comminuting shaft having at least one shaft bearing arrangement is connected directly to a high-pole three-phase synchronous motor of a further drive device and extends axially into the three-phase synchronous motor and the at least one shaft bearing arrangement of the second comminuting shaft is enclosed at least partially by at least one of a rotor device and a stator device of the three-phase synchronous motor.

13. A comminuting apparatus as set forth in claim 1, wherein the comminuting shaft is supported in cantilever relationship at one of its two ends.

14. A comminuting apparatus comprising:

a comminuting shaft having a first end and an opposite second end;

a first bearing arrangement supporting the first end of the comminuting shaft and a second bearing supporting the second end of the comminuting shaft;

the comminuting shaft having a working region disposed intermediate the first and second bearing arrangements;

comminuting tools attached to the working region of the comminuting shaft for cooperating with a counterpart means so as to comminute material to be processed;

a high-pole three-phase synchronous motor connected directly to the comminuting shaft, the motor comprising a rotor and a stator;

wherein at least an axially extending part of the first bearing arrangement axially overlaps with and is surrounded by at least one of the rotor and the stator of the motor.

* * * * *

UNITED STATES PATENT AND TRADEMARK OFFICE

CERTIFICATE OF CORRECTION

PATENT NO. : 7,757,983 B2
APPLICATION NO. : 11/616957
DATED : July 20, 2010
INVENTOR(S) : Lipowski et al.

It is certified that error appears in the above-identified patent and that said Letters Patent is hereby corrected as shown below:

On the Title page,

Insert the following:

Item -- (30) Foreign Application Priority Data

Dec. 28, 2005 (DE) 10 2005 062 963.6 --.

Signed and Sealed this
Thirtieth Day of August, 2011

David J. Kappos

David J. Kappos
*Director of the United States Patent and Trademark Office*